United States Patent [19]

Toesca

[11] 4,002,157

[45] Jan. 11, 1977

[54] GAS TURBINE HEATING APPARATUS

[75] Inventor: Rene A. M Toesca, Boyertown, Pa.

[73] Assignee: Energy Transformation Corporation, Boyertown, Pa.

[22] Filed: Dec. 31, 1974

[21] Appl. No.: 537,717

[52] U.S. Cl. ..... 126/110 B; 60/39.36; 126/116 R

[51] Int. Cl.[2] ..... F24H 3/08

[58] Field of Search ..... 126/110 R, 110 B, 116 R; 60/39.36

[56] References Cited

UNITED STATES PATENTS

| | | | |
|---|---|---|---|
| 868,417 | 10/1907 | Dorcas et al. | 126/110 R |
| 2,400,117 | 5/1946 | Holthouse | 126/110 R X |
| 2,642,858 | 6/1953 | Plesset et al. | 126/116 R |
| 2,879,762 | 3/1959 | Robson | 126/110 R |
| 3,086,579 | 4/1963 | Brown | 126/110 R X |
| 3,163,003 | 12/1964 | Paul et al. | 60/39.36 |
| 3,388,697 | 6/1968 | Muckelrath | 126/110 R |

*Primary Examiner*—William E. Wayner
*Assistant Examiner*—William E. Tapolcai, Jr.
*Attorney, Agent, or Firm*—Nelson E. Kimmelman

[57] ABSTRACT

This heating apparatus includes an air flow chamber having outer and inner, generally cylindrical and parallel walls within which a combustion chamber is nested. The combustion chamber includes means for burning a fuel and has outer and inner parallel, generally cylindrical heat conducting walls. It is coupled to an exhaust duct which has at least a portion thereof surrounded by the inner wall of the air flow chamber. In one form air is driven by an electric fan through the air flow chamber around the combustion chamber and out to a distribution duct. The fan also blows air into the combustion chamber for combustion of the fuel. In another form, a fan is driven by th combustion exhaust gases thereby propelling air through the air flow chamber and into the combustion chamber via a compressor wheel. Other forms include heat-conductive members placed into contact with the exhaust duct or with the air chamber to further heat the air before it enters the distribution duct. Yet another form includes a heat-conductive coil disposed in the exhaust duct to extract heat from the exhaust and to apply it to a fluid circulating through the coil.

20 Claims, 12 Drawing Figures

FIG. 2
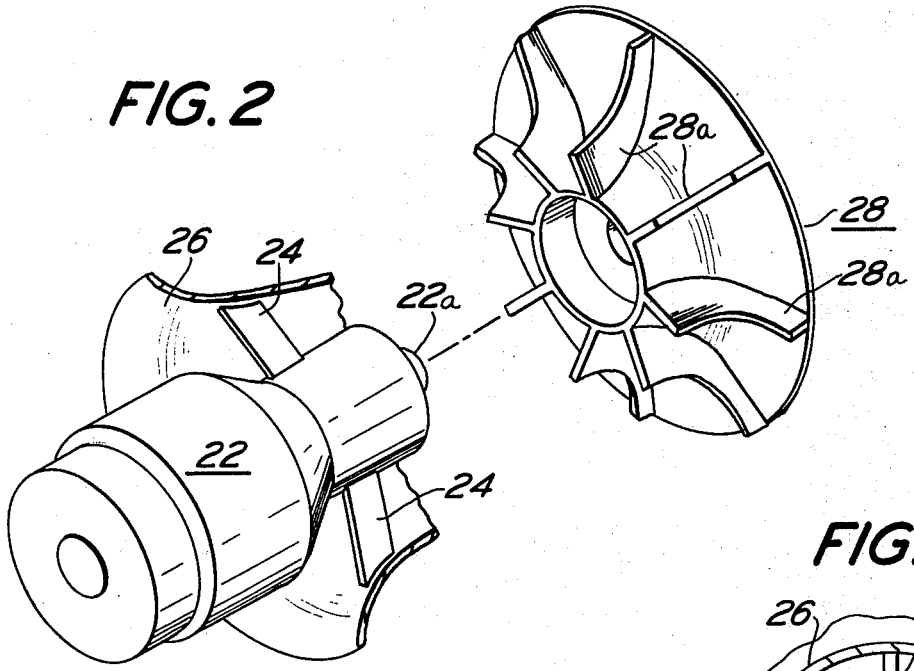
FIG. 3
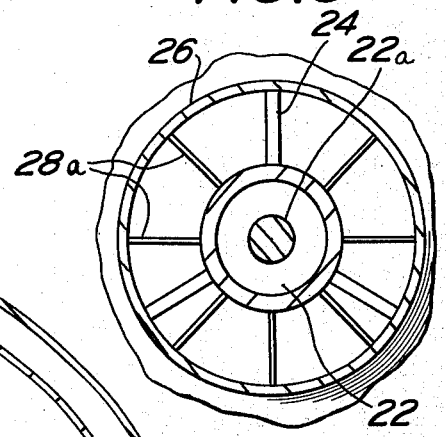
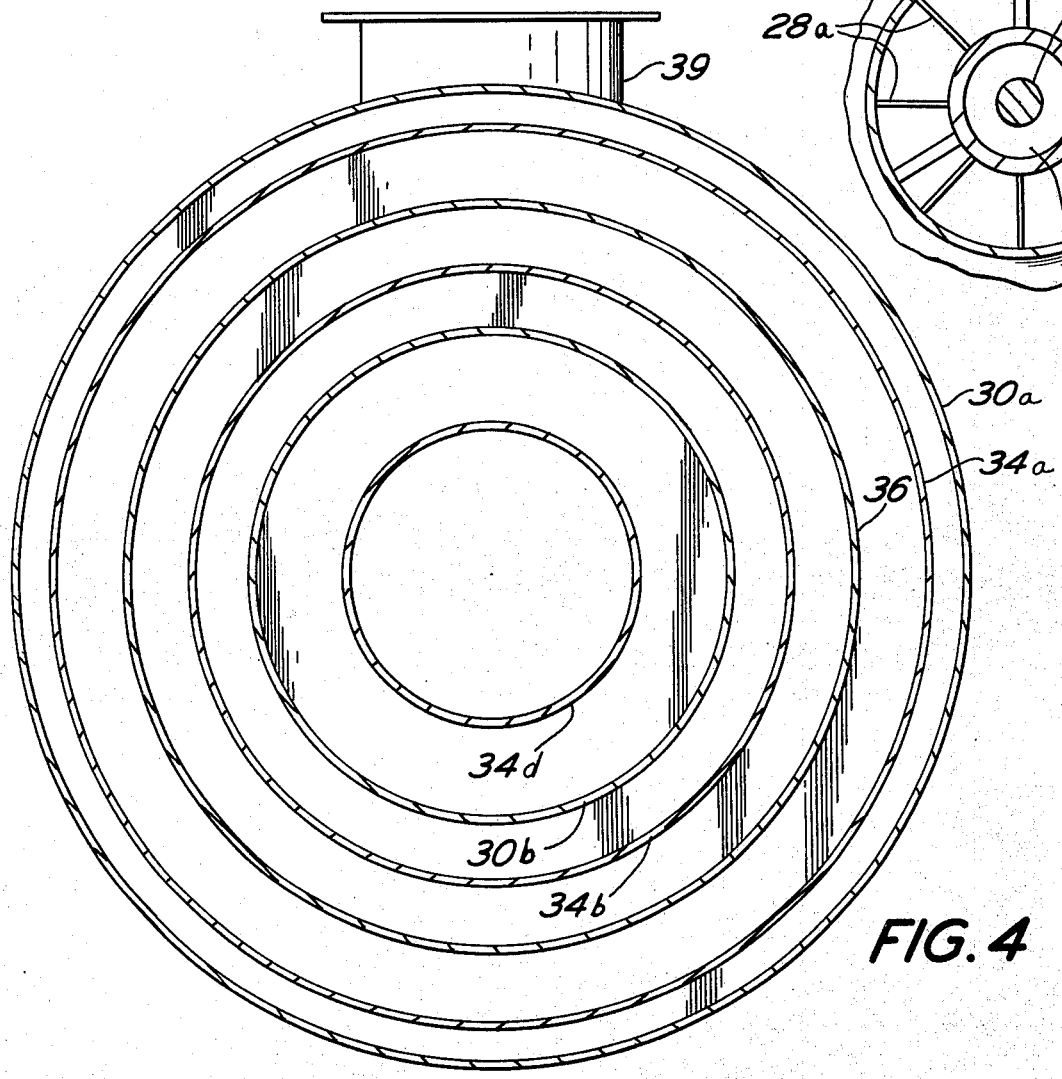
FIG. 4

FIG. 6
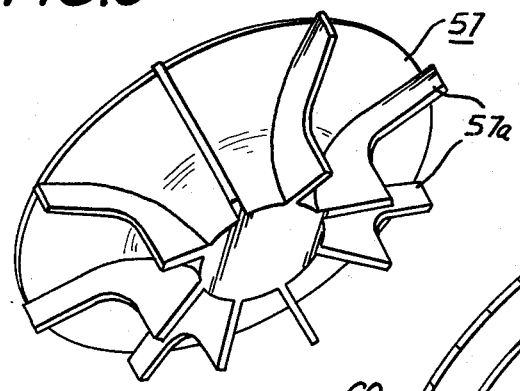
FIG. 7
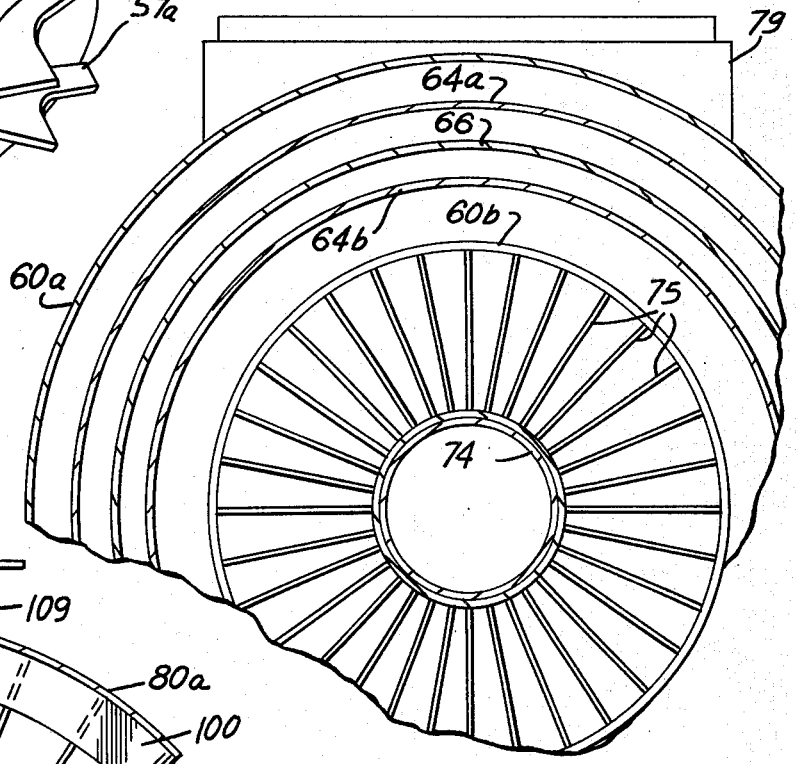
FIG. 9
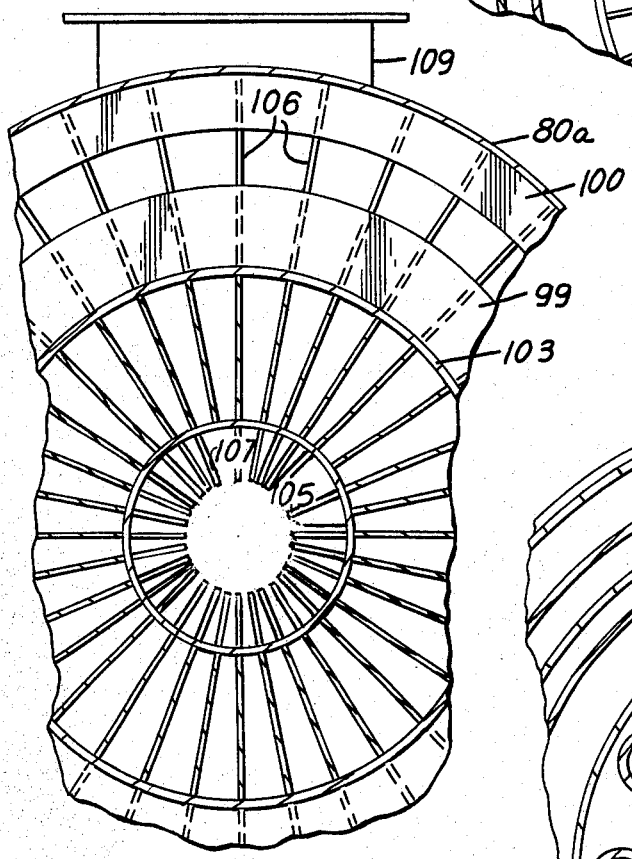
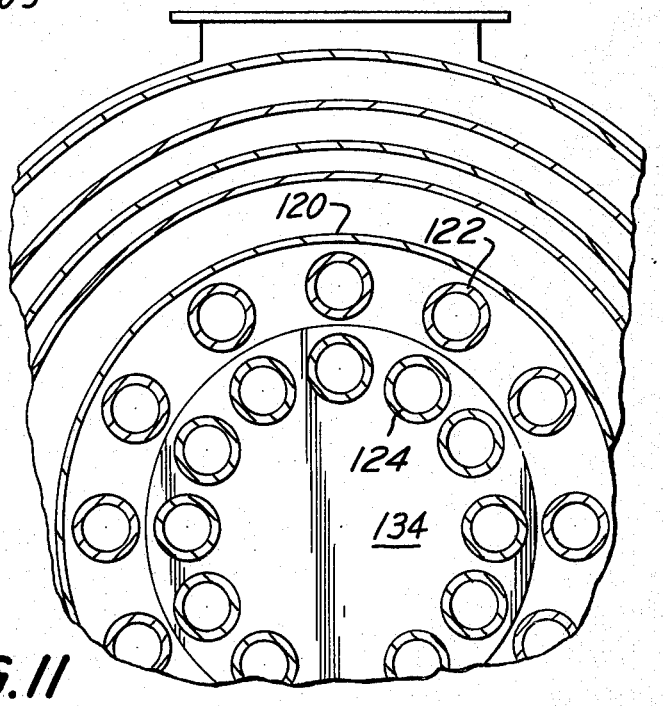
FIG. 11

GAS TURBINE HEATING APPARATUS

BACKGROUND OF THE INVENTION

A. Field of the Invention

This invention relates to heating apparatus and in particular to heating apparatus which employs a gas turbine-like structure or an actual gas turbine used to generate heat and propel heating air to remote areas.

B. Prior Art

In the known art, a gas turbine has been used as a source of power and in such applications the air introduced into the combustion chamber is quite in excess of the amount needed for stoichiometric conditions. Excess air as high as 400% is often a characteristic of gas turbines used for production of power. In such applications, it is desired to reduce heat losses because they subtract from the power output. Thus, conventional gas turbines have not been operated so as to maximize the production of heat rather than power, the two being mutually subtractive.

Conventional heating systems such as oil burners are known in which a first electrically-driven blower is used in the production of the heating oil flame and a second electrically-driven fan is used to propel the air heated by the flame through the ducts to the regions to be heated. There is a substantial need for a self-contained heating apparatus which does not require, in addition to the fuel to be burned, another source of energy such as electricity to propel the heated air to remote points. Even where it is not desired to have a self-powered unit, the high temperatures and high heat transfer coefficients in the combustion chambers of gas turbines or structures similar thereto make them advantageous as sources of heat.

BRIEF SUMMARY OF THE INVENTION

This heating apparatus comprises a combustion chamber in which a fuel is continously burned in air and an air flow chamber adjacent the combustion chamber. Means are provided for causing a first portion of air to enter the apparatus and to circulate through the air flow chamber so that it is heated by the heat of combustion of the heat conducting wall of the combustion chamber. The same means also is used to cause a second portion of air to enter the combustion chamber. In one form, the exhaust gases of combustion are used to power the means for causing air to enter the apparatus, both through the air flow chamber and into the combustion chamber. In another, non selfpowered form, an auxiliary electric motor is used to drive the air to be heated around the combustion chamber and to introduce air into the combustion chamber.

BRIEF DESCRIPTION OF THE DRAWINGS

FIG. 2 is a fragmentary, enlarged perspective view of several of the components of the embodiment shown in FIG. 1;

FIG. 3 is a sectional view of the apparatus taken along the section line 3—3 in FIG. 1 in the direction indicated;

FIG. 4 is a sectional view of the apparatus shown in FIG. 1 taken along the section line 4—4 in the direction indicated;

FIG. 6 is a perspective view of one of the components of the form of the apparatus shown in FIG. 5;

FIG. 7 is a sectional view of a part of the apparatus shown in FIG. 5 taken along the section line 7—7 in the direction indicated;

FIG. 9 is a fragmentary sectional view of a part of the apparatus shown in FIG. 8 taken along the section line 9—9 therein;

FIG. 11 is a sectional view of part of the apparatus shown in FIG. 10 taken along the section line 11—11 in the direction indicated.

DETAILED DESCRIPTION OF THE DRAWINGS

Figure 1:
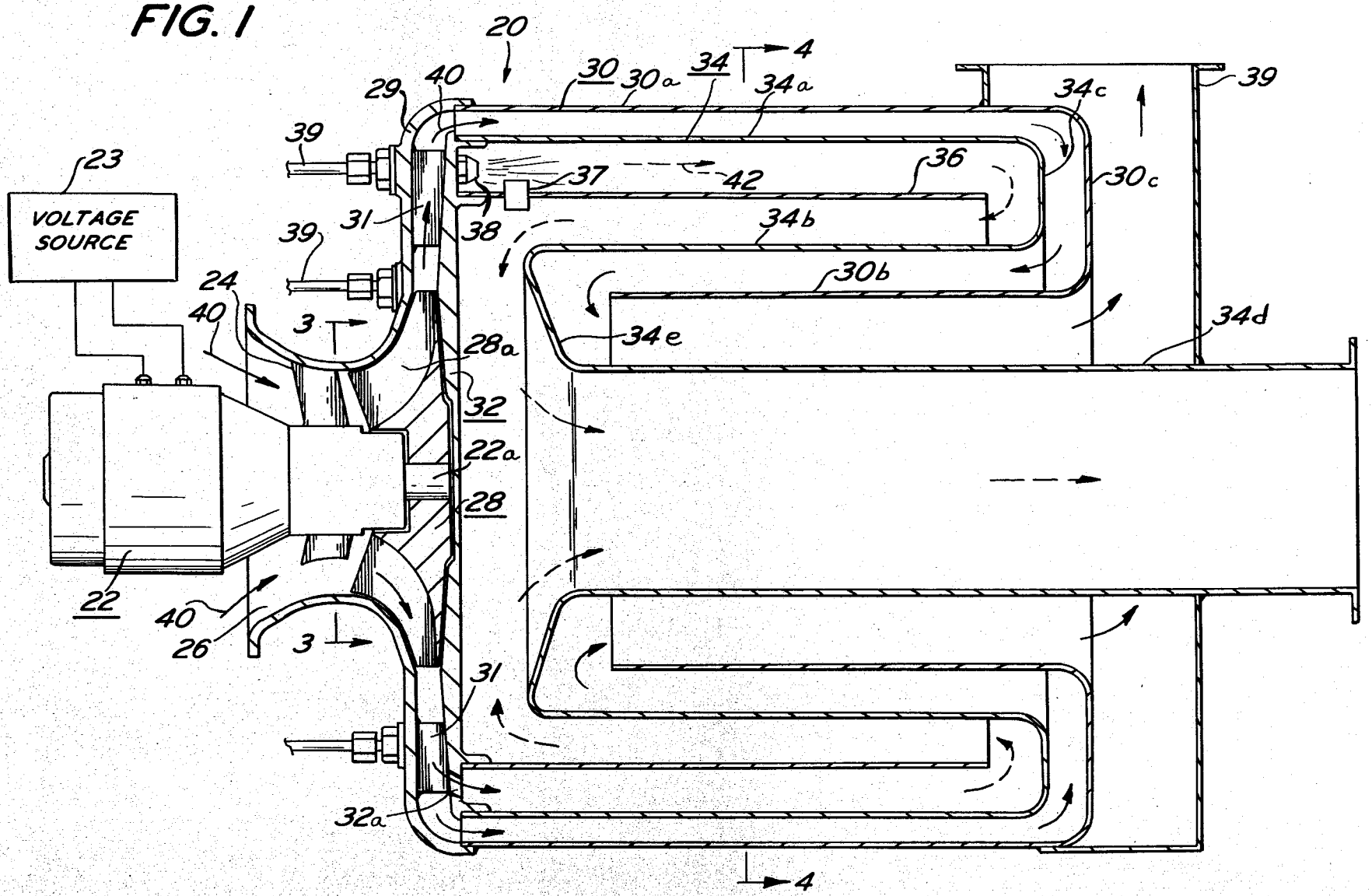
FIG. 1 is a sectional view of gas turbine-type heating apparatus according to one embodiment of the present invention.

Referring to FIGS. 1–4, there is shown a first form of the invention indicated generally at the numeral 20. A motor 22 is mounted by a spider 24 to the outwardly flaring air inlet throat 26. To the shaft of the motor is mounted a compressor or blower wheel 28 having blades 28*a*.

The flared throat 26 is formed integrally with a generally annular housing end portion 29 shaped as shown. The ends of portion 29 are detachably secured, for example, to a generally toroidal metallic member 30 having an external cylindrical wall portion 30*a*, and an interior wall portion 30*b* generally parallel thereto which are connected by a generally annular end portion 30*c* transverse thereto.

Attached to the end portion 29 are a plurality of diffusing vanes 31 spaced at equal angles from one another. These vanes make contact with a generally disc-shaped wall 32 that is fastened by bolts (not shown), for example, to end portion 29. At its edge, wall 32 is fixed to interior wall 34 at the portion thereof marked "34*a*" which is generally parallel to exterior wall portion 30*a*. A transverse end portion 34*c* joins portion 34*a* to another inner wall portion 34*b* which is also generally parallel to the wall 34*a*. The wall portion 34*b* is itself connected to an exhaust duct portion 34*d* by a somewhat funnel-shaped portion 34*e*.

There is also another hollow, generally cylindrical member 36 affixed at one end to the disc-like member 32. Its length is shorter than the wall 34*a* with which it is generally coaxial.

The members 30, 34 and 36 define a plurality of chambers and air or gas flow paths. The walls 34*a*, 34*b* and 34*c* together with member 36 define a combustion region into which atomized fuel is supplied via a plurality of nozzles 38 which may be spaced equiangularly around portion 32 from which they project. They are connected via pipes 39, which also pass through the member 29, to an appropriate source (not shown) of such fuel. To ignite the fuel there is shown schematically at the numeral 37 an ignition means such as a conventional capacitor discharge spark generator which is connected to an appropriate ignition circuit (not shown).

In operation, the motor 22 is started by the application thereto of voltage from voltage source 23 thereby causing its shaft 22*a* to rotate and, with it, the compressor fan 28. This causes ambient air to enter the device as shown by the solid line arrows 40, through spider 24 and then to be engaged by blades 28*a* before passing through the spaces between diffusing vanes 31. It then passes through angled slots 32*a* into the combustion region or chamber defined by the walls 34*a* and 36. The amount of air applied to the combustion chamber is such that the air-fuel ratio therein is allowed to approach stoichiometric conditions tending to maximize heat production rather than power.

At the same time, atomized fuel from nozzles 38 is ignited by sparks, for example, from the ignition system 37. The combustion of the fuel generates heat which is transmitted to the walls 34*a*, 34*b*, 34*c* and 34*d*. The gaseous combustion products are expelled under pressure from the combustion region as indicated by the broken line arrows 42 until they emerge at the end of the exhaust duct or pipe portion 34*d*.

The ambient air which has entered the space between walls 30*a* and 34*a* is heated by hot wall 34*a*. As it continues on its path as shown by arrows 40 it is kept heated by contact with walls 34*c*, 34*b*, 34*e* and 34*d*. The heated air makes its exit from the device via the duct 39 to ducted branches reaching the areas to be heated. Of course, this air may be refluxed as to be heated instead of using ambient air as the input to throat 26.

Figure 5:
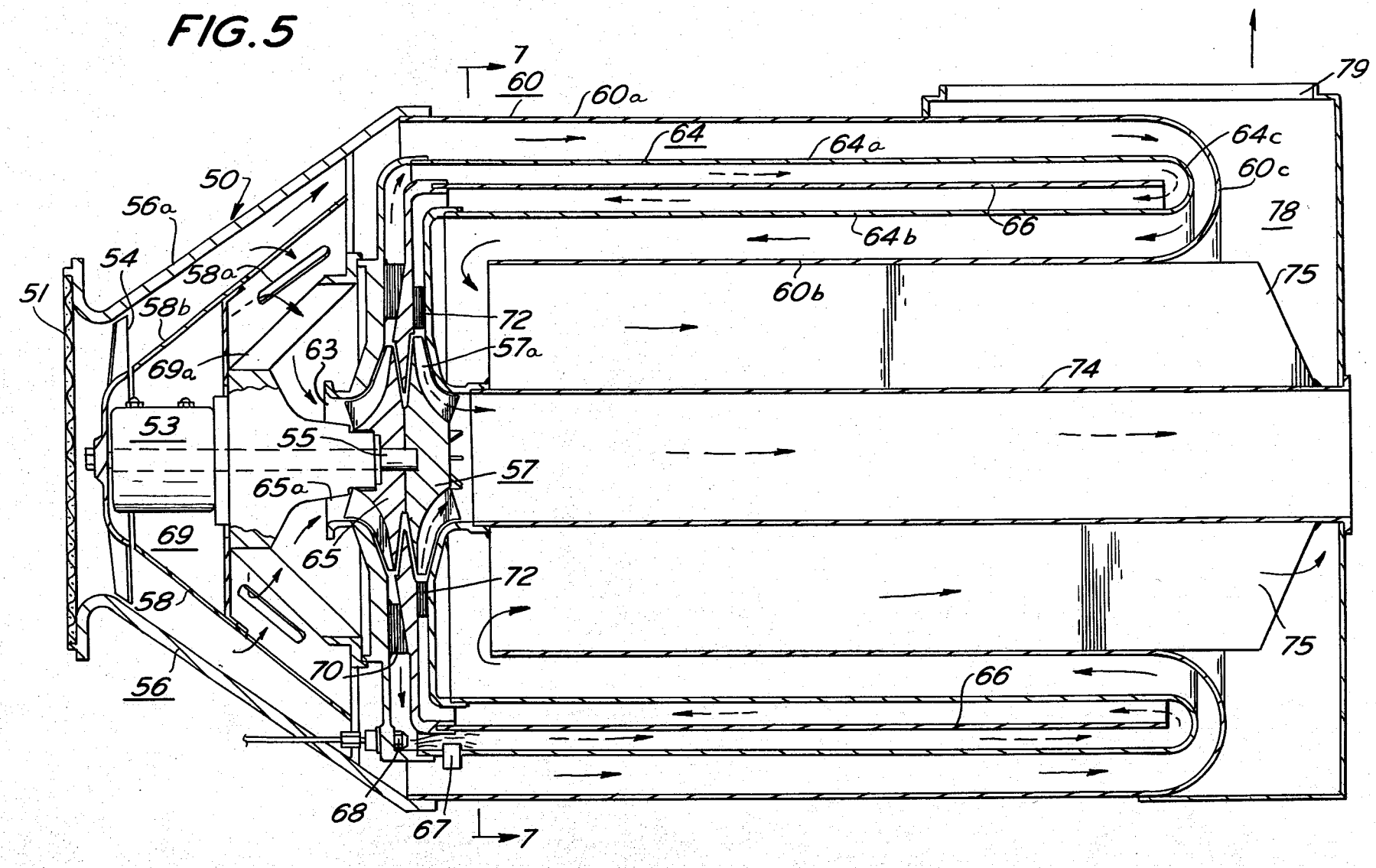
FIG. 5 is a sectional view of another form of the present invention.

FIG. 5 shows another embodiment of the invention in which a turbine is actually used. In this embodiment, the apparatus does not use a motor as the motive force but only as a starting motor. This form, after starting, is then self-powered by conventional gas turbine action. The apparatus depicted generally at the numeral 50, includes an inlet screen 51 for filtering the ambient air. A starter motor 53, which is connected to an appropriate external source of voltage (not shown), causes the shaft 55 connected to a compressor or fan wheel 65 having blades 65*a* to rotate. On the same shaft or otherwise connected to the starting motor 53 is a low pressure fan or blower 54. It sucks in the ambient air which then follows the route indicated by the solid line arrows. Some air proceeds through the clearance between the angled walls 56*a* of the conical end member 56 and the conical wall 58*b* of the member 58. The turbine wheel 57, having vanes 57*a*, is also attached to shaft 55 for rotation therewith.

Attached to the end mount 56 is the exterior wall member 60 having portion 60*a* which is shown as being more elongated than the corresponding wall 30*a* in FIG. 1 although its length is a matter of many design factors. Portion 60*a* is connected to inner, generally cylindrical wall section 60*b* by transverse end wall 60*c*. Together with the similarly shaped walls 64*a*, 64*b* and 65*c* of the combustion region 64, which correspond to the walls 34*a*, 34*b* and 34*c* of the member 34 of the embodiment shown in FIG. 1, they provide a curved path for the ambient air around the combustion region.

As seen, the combustion chamber is divided into two parts by the generally cylindrical wall 66. Fuel nozzles 68, distributed around the axis of the device 50 at equal angular spacing, project into the combustion region 64 as did their counterparts 38 in the embodiment of FIG. 1. Nozzles 68 are connected to an appropriate source of fuel (not shown). To ignite the atomized fuel from nozzle 68 a spark ignition system or the equivalent, indicated schematically by the rectangle 67 is provided. Once combustion has begun, the gas pressure generated in the combustion chamber 64 follows the route taken as indicated by the broken-line arrows until it engages the blades 57*a* of the turbine wheel 57, which is coupled to the compressor wheel 65.

The compressor wheel 65 is initially revolved by the starting motor 53, but when combustion is under way in the combustion region 64 the starting motor is turned off. Thereafter wheel 65 is driven by exhaust gas pressure against the blades 57*a* and the turning of the turbine wheel drives the compressor wheel 65 and the fan 54 all of which rotate in unison. Consequently, compressor wheel 65 will pump ambient air into the combustion chamber that has been blown in by the fan blades 54 through the slots 58*a* and through the openings 69*a* in the spider motor mount 69.

Ambient air is sucked through the throat 63 by the blades 65*a*, passes outwardly through the diffuser vanes 70 and into the combustion chamber 64 defined by the walls 64*a*, 64*b* and 64*c* where the atomized fuel from the nozzle 68 is being ignited by the ignition system 67. The combustion gases pass in the space around the wall 66, through the diffuser vanes 72 and engage the vanes 57*a* of the turbine wheel 57 causing it to revolve. The the exhaust gases proceed out through the central duct 74 to exhaust.

Attached to the duct 74 are a plurality of heat conducting vanes 75 which also make contact at their outer edges with the wall 60*b*. Hence, the duct 74 becomes heated internally by the exhaust gases proceeding through it and loses heat by conduction to the wall 60*b*. The warm air that is to be circulated throughout the region to be heated is driven by the fan blades 54 in the space between walls 60*a* and 64*a* around the combustion chamber. It is initially heated there and, arriving at the left end of the wall 60*b*, reverses direction again. It then goes between the hot vanes 75 to the right toward plenum 78 whence it exits from the duct end 79 to whatever distribution ducts are attached thereto.

Figure 8:
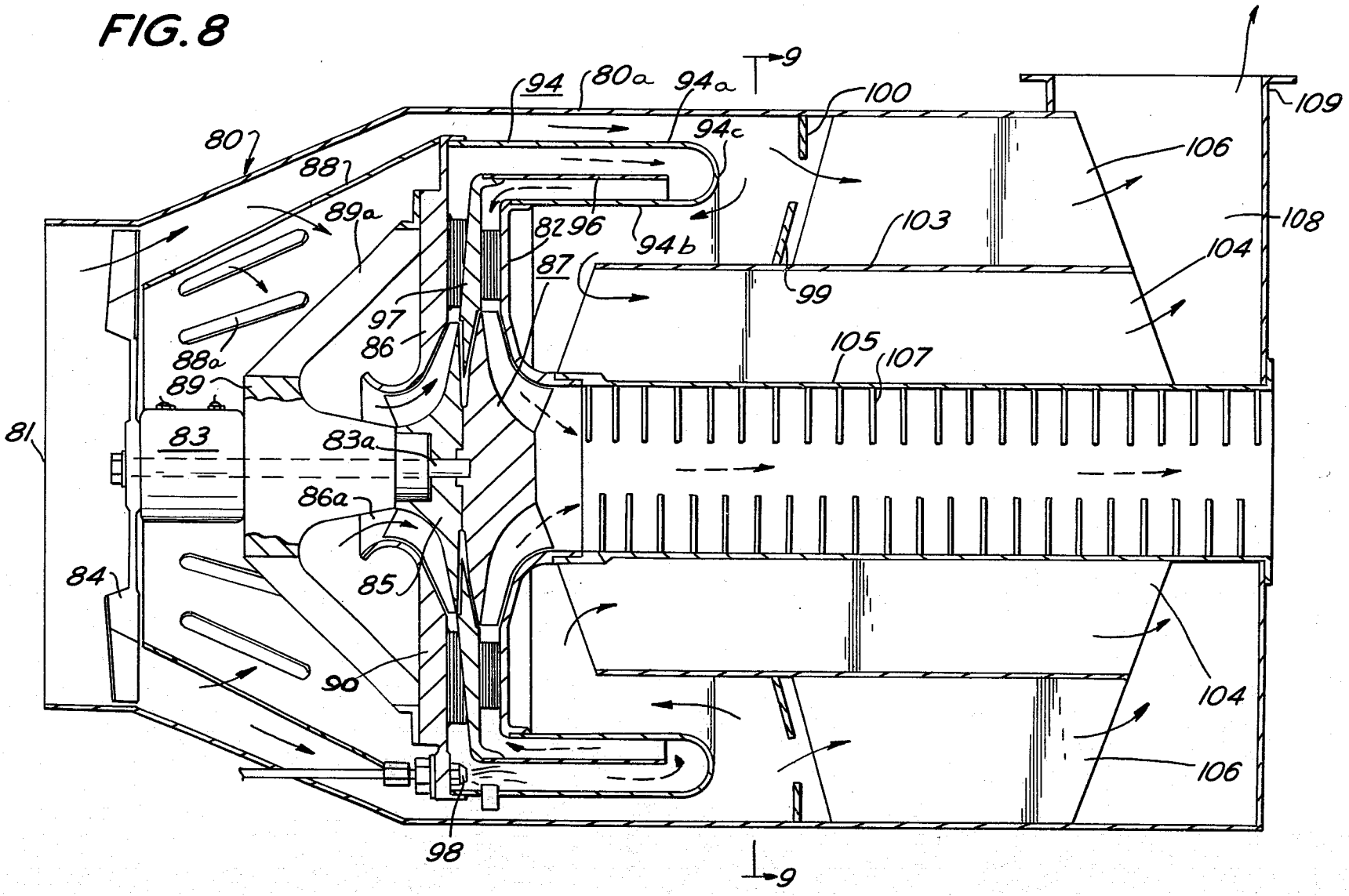
FIG. 8 is a sectional view of still another form of the present invention.

FIG. 8 shows another form of the invention which is somewhat more compact than the previous embodiments. This device pictured generally at 80 has an inlet screen 81, a lower operating speed and hence a more quiet fan 84. It also has a housing 88 provided with a plurality of slots 88*a* that is attached to the generally annular left end portion 86 of the turbine. A motor mount or spider 89 provided with a number of openings 89*a* supports starting motor 83 and a compressor wheel 85 and a turbine wheel 87 are both fixedly mounted to the same shaft 83*a*. It also has an external generally cylindrical housing wall 80*a* opening into a plenum 108 at the right.

It is seen that the combustion chamber 94 in which the nozzle 98 is located is much shorter than the combustion chamber depicted in FIG. 5. The combustion chamber is defined by the wall portions 94*a*, 94*c* and 94*b* and is divided by a generally cylindrical wall 96 attached at the left to a stationary, generally annular member 97. Member 97 is bolted to end portion 86 and to another annular member 82 that supports the edge of wall portion 94*b*.

Some of the ambient air passes through fan blades 84 and into the space between the walls 80*a* and 94*a* until it meets the two part baffle 99, 100. Baffle 99 is generally annular and conical and is attached to the cylindrical wall 103 along its inside edge. Baffle 100 is annular and is attached to the inner surface of the wall 80*a*. The annular space between these two baffles provides resistance to the ambient air flow and serves to divert a portion thereof around the outside surface of walls 94*c* and 94*b*. It then flows into the spaces between the vanes 104 that are attached to the outer surface of the cylindrical wall 105 which constitutes the exhaust pipe. The air leaves the vicinity of the vanes 104 at their right edges and proceeds out through the plenum 108 to the flanged end 109 which connects to conduits taking it to the areas to be heated.

The portion of the heating air going through the clearance between baffles 99, 100 passes through the spaces between the second set of vanes 106 and then into plenum 108 whereupon it goes out the flanged end 109.

Another portion of the ambient air goes through slots 88*a* and the spaces in the spider 89 into the throat 86*a*. It is pumped outwardly by the blades of compressor 85 through diffuser vanes 90 into the combustion chamber 94.

The hot exhaust gases follow a path in the combustion chamber 94 in much the same manner as they circulate through their counterparts 64 shown in FIG. 5. When they drive wheel 87 and enter the exhaust duct 105, they heat a plurality of pins 107 which conduct the heat to the wall 105. It in turn conducts it to the inner edge of vanes 104 attached thereto. The heat then travels through vanes 104 to cylindrical wall 103 to which vanes 106 are fixed. The sets of vanes 106, 104, wall 103, exhaust duct 105 and the pins 107 may be formed integrally as by a one piece casting. After heating the pins 107, the exhaust air proceeds out the end of the exhaust pipe.

In addition to its greater compactness, the embodiment shown in FIG. 8 has the advantage of lower noise since there is a greater volume through which air to be heated may pass and the fan 84 can be designed accordingly.

Figure 10:
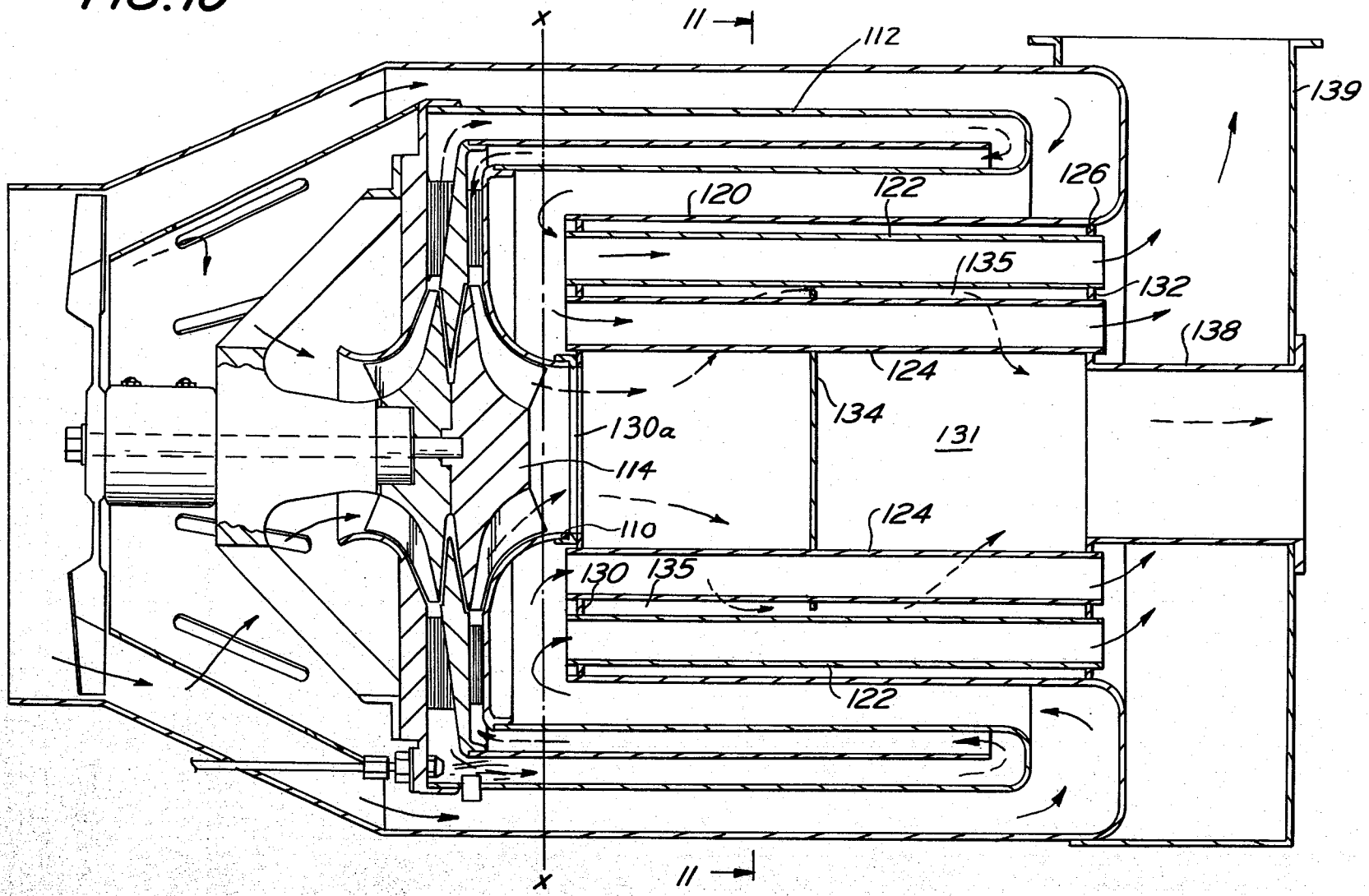
FIG. 10 is a sectional view of yet another form of the present invention.

FIG. 10 shows an embodiment which is, on the left side of the line X—X, essentially the same as the corresponding part of the embodiment shown in FIG. 8. However, its combustion chamber 112 is longer and the final part of the flow of ambient air around the exhaust pipe is different. Instead of passing between vanes fixed to the exhaust duct as in FIGS. 5 and 8, the exhaust gases enter a region bounded by the generally cylindrical wall 120 and perforated annular end plates 130 and 132. End plate 130 is sealingly fixed at its inner edge to the inner edge of generally annular mounting member 110. There are a plurality of tubes 122 of a heat-conductive material arranged in an outer circular row, being supported at opposite ends by a corresponding circular row of circular openings formed in perforated annuli 130 and 132. There is also another inner circular row of tubes 124 made of heat-conducting material which are inserted in a corresponding inner circular row of openings in the plates 130, 132. A disc-like baffle 134 is positioned approximately half way down the length of the exhaust having holes through which tubes 124 pass.

Exhaust gases which rotate the turbine wheel 114 enter the central bore 130*a* of the perforated annular member 130 and because of the baffle 134 are deflected somewhat laterally into the spaces 135 between tubes 122 and 124. The gases then move longitudinally past the baffle 134 and then move transversely inwardly toward the axis of the turbine into the space 131 and then out through the terminal portion 138 of the exhaust pipe. Since the exhaust gases are quite hot, they heat the tubes 122, 124 and the heating air flowing through them which is then fed via the outlet duct 139 to the region to be heated.

Figure 12:
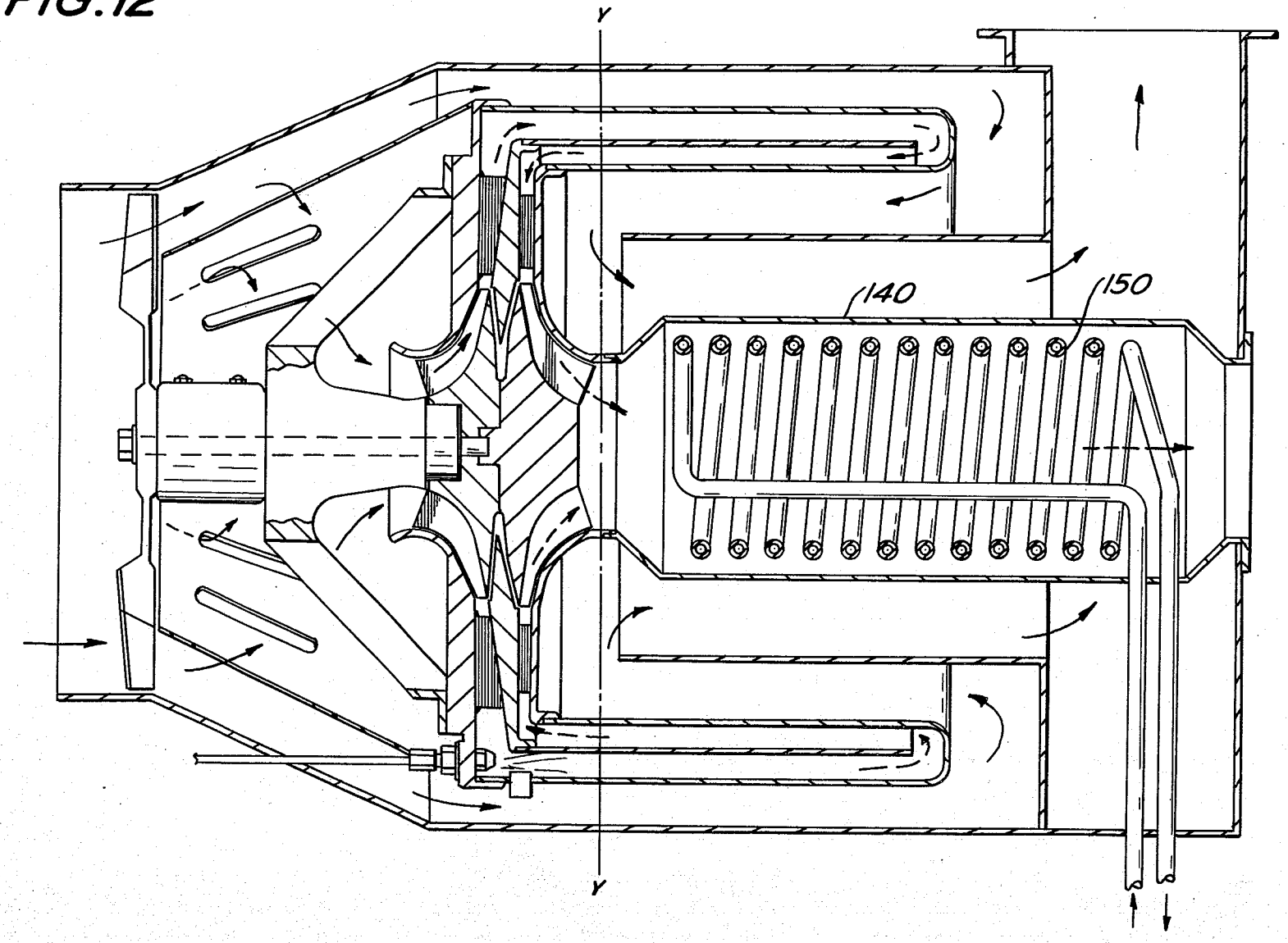
FIG. 12 is a sectional view of another form of the present invention.

FIG. 12 shows still another embodiment of the present invention in which the tubular "muffler" arrangement of FIG. 10 for the exhaust gases is replaced by a heating coil 150 through which an appropriate liquid medium such as water flows. The coil here is heated by the exhaust gases and the water in it used to heat the desired region or used for some other purpose while the air passing in contact with the outside wall 140 of the exhaust section is used for heating the desired area. The portion of the embodiment to the left of line Y—Y is identical to the portion of the form shown in FIG. 10 to the left of line X—X.

Other forms and embodiments of the present invention may occur to one perusing the present specification and drawings which do not depart from the essence of the invention. Consequently, it is desired that the invention be limited solely by the claims which follow.

I claim:

1. Heating apparatus comprising:

a. a combustion chamber having walls formed to cause exhaust gas to travel initially in a first direction and then to travel in a second direction opposite thereto, b. an air flow chamber adjacent thereto and being formed to conduct incoming air first past the outer wall of said combustion chamber in said first direction, and then past the inner wall of said combustion chamber in said second direction, and c. means for causing air to enter said apparatus and for causing a first portion thereof to circulate through said air flow chamber whereupon it is heated by the walls of said combustion chamber prior to its being applied to heat a predetermined area, said means also causing a second portion of said air to enter said combustion chamber thereby to enable combustion therein.

2. The heating apparatus according to claim 1 wherein said (c) means comprises a compressor wheel and a turbine wheel mounted for rotation in unison, said turbine wheel being driven by the exhaust gases generated by the combustion of said fuel in said combustion chamber.

3. The heating apparatus according to claim 2 wherein said (c) means includes a fan also mounted for rotation in unison with said compressor and turbine wheels.

4. The heating apparatus according to claim 1 wherein said combustion chamber is formed so that the exhaust gases of said combustion first travel in one direction generally parallel to the axis of said apparatus and then travel in the opposite direction.

5. The apparatus according to claim 1 with the addition of an exhaust duct disposed along the axis of said apparatus and being in communication with said combustion chamber.

6. The apparatus according to claim 5 with the addition of heat-conductive means disposed within and along said exhaust duct to facilitate heating of a fluid within said duct.

7. The apparatus according to claim 1 wherein said (c) means is constructed to cause the amount of said second portion of air to be such that the air-fuel ratio in said combustion chamber is allowed to approach stoichiometric conditions.

8. The apparatus according to claim 6 wherein said duct is associated with means adjacent thereto for conducting outwardly heat from the walls thereof and wherein said air flow chamber includes a region adjacent said exhaust duct so that said first portion flows around said heat-conducting means associated with said exhaust duct.

9. The apparatus according to claim 8 wherein said associated heat-conducting means includes a plurality of vanes in contact with said duct.

10. The apparatus according to claim 1 with the addition of a plurality of heat-conductive tubes arranged in communication with said air flow chamber so that heated air therefrom flows through said tubes and with the addition of means coupled to said combustion chamber for directing the hot exhaust gases therefrom into contact with the outer surfaces of said tubes before said exhaust gases are withdrawn from said apparatus.

11. Heating apparatus according to claim 1 wherein said combustion chamber is divided into two generally concentric regions by a generally cylindrical wall and wherein said air flow chamber is substantially divided into two generally concentric regions by said combustion chamber.

12. Heating apparatus according to claim 1 wherein said air flow chamber is formed so that said incoming air, after flowing in said air flow chamber in said second direction, is then made to flow in said first direction again just before it is conducted out of said heating apparatus to heat said predetermined area, the flow of said air in said air chamber being generally increasingly closer to the axis of said apparatus from the beginning to the end of its path therein.

13. Heating apparatus comprising:

a. a chamber having outer and inner, generally cylindrical and parallel walls, b. a combustion chamber disposed within said (a) chamber and including means for continuously burning a fuel in air therein, said chamber having outer and inner parallel, generally cylindrical, heat-conducting walls, c. an exhaust duct having a substantial portion thereof surrounded by the inner wall of said (a) chamber, said duct having a heat-conductive wall communicating with said (b) chamber, d. means for causing air to enter said apparatus, said means including:

1. means to cause a portion of said air to flow through said (a) chamber and along the outer surface of the heat-conducting wall of said exhaust duct when combustion of said fuel has heated the heat-conducting wall of said combustion chamber, said air thereupon being heated and being adapted to be applied to heat a predetermined area, and 2. means for causing another portion of said air to enter said combustion chamber thereby to enable combustion of said fuel to occur, the amount of said other portion being such that the air-fuel ratio in said combustion chamber is allowed to approach stoichiometric conditions.

14. The apparatus according to claim 13 wherein said (d) (1) means causes said portion of said air to flow in a first direction and then to flow in the opposite direction before reversing direction once again and flowing along said exhaust duct.

15. The heating apparatus according to claim 13 wherein said exhaust duct has an entrance connected to the inner one of said parallel walls of said combustion chamber.

16. The heating apparatus according to claim 13 wherein said (d) means includes an electrically driven fan that causes both of said portions of air to enter said apparatus.

17. The apparatus according to claim 13 wherein said (d) means includes a fan powered by the exhaust gases produced within said combustion chamber.

18. The apparatus according to claim 17 wherein said fan also moves air toward said combustion chamber.

19. The apparatus according to claim 13 wherein said (d) (1) means includes a fan and wherein said (d) (2) means includes a compressor wheel which pumps air propelled by said fan into said combustion chamber.

20. The apparatus according to claim 1 wherein said combustion chamber is effectively divided into two parallel communicating parts and wherein the air pumped in by said compressor wheel travels through one of said parts in one direction and then reverses field and travels through the other part in the opposite direction.

* * * * *